United States Patent [19]

Lindbloom

[11] 4,074,371

[45] Feb. 21, 1978

[54] MOTORIZED HIDE-A-BED ACTUATING MECHANISM

[75] Inventor: John L. Lindbloom, Overland Park, Kans.

[73] Assignee: Christian Services, Inc., Lee's Summit, Mo.

[21] Appl. No.: 712,608

[22] Filed: Aug. 4, 1976

[51] Int. Cl.[2] ..... A47C 17/14

[52] U.S. Cl. ..... 5/13; 5/18 B; 5/43

[58] Field of Search ..... 5/13, 14, 17, 18, 47, 5/63, 66

[56] References Cited

U.S. PATENT DOCUMENTS

| | | | |
|---|---|---|---|
| 2,308,592 | 1/1943 | Drexler et al. | 5/66 |
| 2,972,753 | 2/1961 | Thomas | 5/13 |
| 2,982,974 | 5/1961 | Bronstein | 5/13 |
| 3,233,255 | 2/1966 | Propst | 5/66 |
| 3,458,877 | 8/1969 | Edwards | 5/13 |

*Primary Examiner*—Casmir A. Nunberg
*Attorney, Agent, or Firm*—Clarence A. O'Brien; Harvey B. Jacobson

[57] ABSTRACT

A motorized actuating mechanism for attachment to sofabeds, hide-a-beds and the like in order to make the opening and closing operation of said beds fully automatic. The mechanism is installed into the existing frame of the sofabed and a switch is installed on the outside of the sofa in order to activate the mechanism. The mechanism includes a main support frame which is attachable to the main frame of the sofa, a reversible drive motor mounted upon said main frame for actuating a threaded lead screw, a cross drive member driven by said lead screw in a reciprocating manner, double parallel slotted track members for constraining and guiding the cross drive member in a desired manner, a pair of linkage connectors, pivot arms, lower frame pivot arm mounts, upper frame cross rod, and upper frame mount for attachment to the bed portion of the sofa. The switch associated with the mechanism is spring biased to the off position and one of the two on positions drives the motor in a direction to open the bed and in the other on position drives the motor to operate the mechanism in order to close the bed. A large lever is provided for the switch which may easily be operated by the elderly and infirm.

5 Claims, 6 Drawing Figures

MOTORIZED HIDE-A-BED ACTUATING MECHANISM

BACKGROUND OF THE INVENTION

1. Field of the Invention

This invention relates generally to devices for use with couches and sofas which make up into a bed and is specifically for the purpose of converting said opening structure to a fully power operated assist mechanism so that invalids or elderly people may open and close the bed portion of the sofa without any great effort on their part.

2. Description of the Prior Art

A common problem with known types of power operated mechanisms for sofabeds, hide-a-beds, and the like, is that they are normally built into the specific construction of said couch-bed and are not readily adaptable for installation in sofabeds which are readily in use in users' homes, or easily installed at the factory without modification of the existing couch-bed construction.

Another problem with known type devices are that they often are used with intricate end over end type bed structures and employ a completely lineal motion rather than a bed seat arrangement wherein the back of the seat becomes part of the bed.

Another problem with known type devices are that they move in a flat horizontal path and do not provide an arc-type motion as is necessary for proper operation of many type sofabeds.

Another problem with known type devices is that they use hydraulic or pneumatic operated mechanisms which have a serious drawback in that in the case of hydraulic systems if the hydraulic lines or any of the components thereof should leak or rupture then there will be great damage done in the normal household or nursing home due to the spilling of oil over carpets, floors, linoleums, and the like. Also, when such ruptures or leakage occurs obviously the actuating mechanism is rendered inoperative.

Another problem with known type devices is that they are awkward and clumsy, noisy and frightening in operation, and often times dangerous in operation.

Another limitation is that most of these mechanism are not readily usable or adaptable to various type sofabed arrangements as already existing, and cannot be installed in the sofabeds as constructed without modification.

Known prior art patents which might be pertinent to this invention are as follows; U.S. Pat. Nos: 2,934,770, S. C. Willis et al., May 3, 1960; 2,972,753, J. R. Thomas, Feb. 28, 1961; 2,982,974, E. L. Bronstien, May 9, 1961; 3,028,607, B. B. Anderson, April 10, 1962.

None of these known prior art devices offers the new and unique features of the invention disclosed herein.

SUMMARY OF THE INVENTION

An object of the present invention is to provide a motorized actuating mechanism for sofabeds and the like which will be readily adaptable to such sofabeds as presently manufactured without modification thereto and which will when attached thereto completely motorize the opening and closing function of said structures.

Another object of the present invention is to provide a motorized actuating mechanism for hid-a-beds which will make them fully automatic and under control of a three-way switch structure. The switch has a normally spring biased in the center open or off position and when pushed to a position away from the center off position will operate the mechanism to open the bed while upon release thereof under the spring biasing will automatically shut off. In the other direction, the mechanism will be operated to close the bed. A large lever is provided on the switch for easy push operation thereof. The switch is normally attached at one end of the sofa construction within easy access of an elderly or invalid-type person.

A further object of this invention is to provide a positive actuating mechanism for sofabeds having screw mechanism driven in forward and reverse directions by a single reversible electric motor together with associated guide tracks, actuating linkages and levers for opening a sofabed according to a predetermined arc or flight path as it were.

An important feature of the motorized actuating mechanism of this invention is in the fact that it may be readily attached to sofabeds and hid-a-beds as normally constructed and built without any modifications thereto. The kit or mechanism is installed into the existing frame of a sofabed and the switch included therewith is installed on the outside of the couch in order to activate the mechanism. An operator stands beside the couch and presses the switch in the forward or reverse position to either open or close the bed. When pressure on which the switch is released at any time, the unit immediately stops in the position of the bed as maintained at the moment.

One full cycle is equivalent to opening and closing the unit. Normally, the motorized hide-a-bed will be opened at night into the sleeping or bed position and closed in the morning. Although the average frequency of operation is one to two cyles per day, the motorized hide-a-bed actuating mechanism kit can be safely operated at greater frequencies. Normally, the life of this mechanism should be many years. It is relatively maintenance free, and is very positive in actuation, and yet because of the type of large lever switch which is normally spring biased to the off position, it is quite safe.

The motorized hide-a-bed actuating kit installed in sofabeds and the like will normally be used in retirement villages as a self-assist item. The motorized hide-a-bed actuating kit will reduce the physical effort normally involved when operating an unmotorized hide-a-bed. By decreasing physical effort by the users thereof, the motorized sofabed actuating mechanism should promote longevity of the users and reduce accidents among the older people.

Besides providing the residents of such villages with a comfortable full length couch, they can push a switch and instantly convert the couch into a sleeper. The bed and kit will also be very useable and popular in small living areas such as business offices, hotel suites, and convention rooms.

Since this bed mechanism can be operated by the handicapped, elderly and very yound people; any psychological feelings or fear that a sofabed is difficult to operate will be completely eliminated with the motorized actuating kit as installed in such a sofabed. The automatic couch will be used by people who are unable or don't want to lift, or by people relatively unfamiliar with the operation of a sofabed, for example, guests in a motel or hotel.

Also, because of its durable basically all-steel construction, together with the simple design thereof, the motorized actuating kit will provide extra support for the normal type sofabed with which it will be installed. Thus the overall structure of the sofabed with the kit installed will require minimum maintenance, have greater longevity, and with proper usage should last longer than the sofa itself.

The motorized actuating mechanism of this invention is equipped with unique elements and linkages for transmitting the proper mechanical movement to the bed in order to automatically open or close the sofabed.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
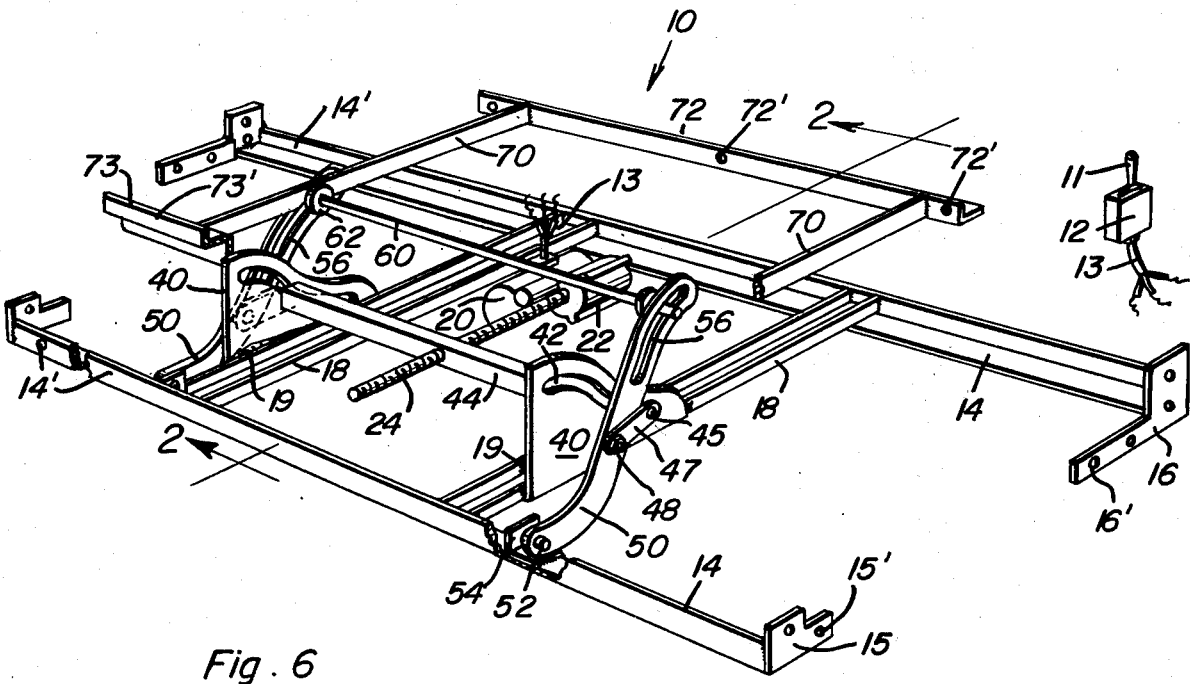
FIG. 1 is a perspective view of the motorized actuating mechanism for use with a sofabed.
Figure 6:
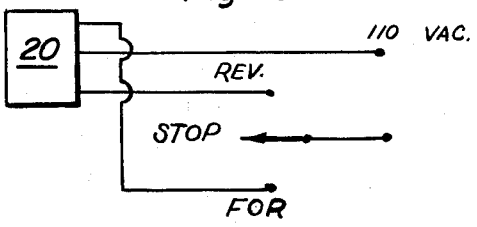
FIG. 6 is a schematic diagram of the switch arrangement for the motor of the mechanism of this invention.

Referring to FIG. 1 of the drawings, reference numeral 10 indicates in general, the bed actuating mechanism of this invention prior to installation in a sofabed and the like. To the right of the drawing of FIG. 1 is shown the large actuating lever 11 for the electric switch 12 connected by appropriate wiring 13 to the motor drive for the actuating mechanism. The motor 20 is connected through a gearbox 22 to a lead screw 24. The switch 12 and enclosure therefor may be mounted at either end of the sofabed or couch, and has been modified by providing an arthritic bar style handle. This handle 11 is quite large and may conveniently be operated by merely pushing same in one direction or the other. The normal operation of this switch is such that in the upright and mid-position of the switch as shown in FIG. 1, the switch is in the off position. By pushing the switch lever forward, the switch will be turned on and the wiring will be appropriately connected (FIG. 6) so that this will be the open position for the motor and actuating mechanism. By throwing the switch in the opposite direction, the motor will be energized in the opposite direction and this will be the closed position for the hide-a-bed.

The actuating motor 20 may be a 1/10 horsepower, 110 volt a.c., split capacitor, intermittent use type having automatic thermal overload and enclosed limit switches. A motor such as that provided by the Von Weise Corporation under Model No. VW-76 has been found to be very satisfactory. The lead screw 24 may be an acme thread lead screw of approximately ⅝-inch diameter by 12 inches in length mounted parallel to the motor and extending longitudinally from the gearbox 22. A ball lead screw of the same approximate dimensions has been found to be slightly better for this application in place of the acme thread lead screw. A follower nut 32, see FIG. 2, made of brass, delryn plastic, or of the ball-type, travels along the lead screw and is suitable attached to the cross drive shaft 44.

The aforesaid structure is appropriately mounted from the lower frame mount, which basically consists of the angle iron pieces 14 of approximately 3/16 inch steel material by 1½ inch by 54 inches in length. End mounts 15 and 16 are welded to the respective ends of the members 14. These end pieces have appropriate apertures 15' and 16' provided therein for permitting screw or bolt attachment of the end pieces to the wood frame structure of the sofabed with which the mechanism will be used. Cross pieces 18 of U-shaped channel are welded between the angle iron pieces 14. These cross channels 18 are of approximately 3/16 inch thick material by 1¼ inch by 2¼ inch by 24 inches in length. These dimensions may be varied for different applications with various sofabeds, hide-a-beds, etc. but the given dimensions have been found to be useful with most conventional applications. For example, the "Magic Bed" by the FlexSteel Corporation will accept the actuating mechanism kit as described and as mentioned above exactly without any modifications whatsoever.

Figure 2:
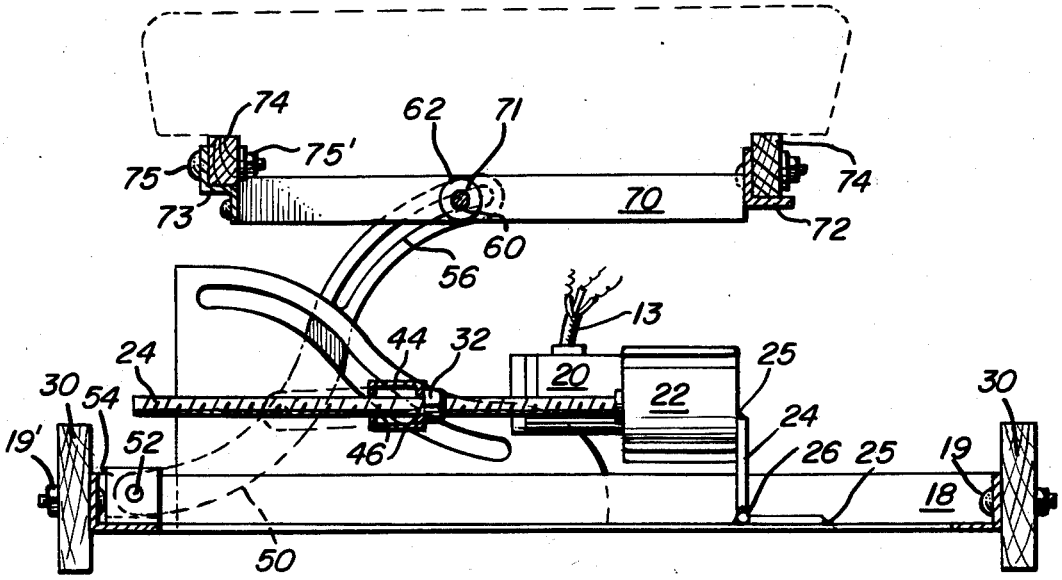
FIG. 2 is a side elevational view, partly in cross section, of the mechanism of FIG. 1.

Slotted track members 40 are welded 19 to the outside portions of cross member 18. These members are constructed of 3 1/16 inch steel plate and include the guide slots 42 of the special reverse S configuration shown in FIGS. 1 and 2. A cross drive shaft 44 is mounted by means of pins extending from each end thereof with said pins riding in the slots 42 of the slotted track members 40. The cross drive shaft 44 may be constructed of steel tubing of approximately 3 1/6 inch thickness by 1¼ inch by 1¼ inch by approximately 22 inches in length. The head of the right connecting pin is indicated by reference numeral 45 in FIG. 1. Linkage connectors 47 are pivotally mounted on the pins and retained by the head portions 45 as best seen in FIG. 1. The linkage connectors 47 are steel strips of 3/16 inch thickness by 1¼ inch by 5 inches in length being located at each end of the cross drive shaft at one end thereof and at the other end pivotally connected by pivot point 48 to the pivot arms 50. The lead screw nut 32 is appropriately welded or otherwise fastened at the approximate center of the cross drive shaft 44 with the lead screw running through center holes 46 provided on two sides of the cross drive shaft member. As can be easily visualized by looking at the drawings, when the lead screw turns, the nut and associated cross drive shaft will move longitudinally of the cross members 18 with the ends of the cross drive shaft being guided by the pins 45 in the slotted tracks 42. Since with this manner of operation, the plane of the lead screw will change, the motor 20 and associated gearbox 22 must be pivotally mounted. FIG. 2 shows this mount consisting of a hinge member 24 having a hinge pivot point 26 and appropriately connected to the gearbox 22 and the cross channel 18 by welding 25.

The pivot arms 50 are supported from the front lower frame angle bar member 14 by means of the pivot arm mounts 52, 54. These angular pivot arm mounts are welded to the lower frame mount. The pivot arms 50 are 3/16 inch steel plate by 1½ inch wide by 15 inches in length, and pivot from the mounts by pivot pins 52. The other end of each of the pivot arms is provided with a slot 56 as shown. A cross rod 60 has the respective ends thereof riding and extending through slots 56 in the pivot arms. This structure provides one of the important features of this mechanism which is in the correct push angle on the cross rod 60 by the pivot arms as driven through the links 47 and the cross drive shaft 44.

The upper frame mount is provided by the steel members 70 which extend between angle members 72 and 73 and appropriately attached thereto by welding or the like. The extreme ends of the round rod 60 extend through apertures 71 provided in the members 70. Appropriate washers 62 are also welded near the ends of the rod 60 to positively retain same in the proper position between the slots 56 and the apertures 71 in the cross members 70. Thus, as can be readily visualized when the pivot arms 50 are moved back and forth relative to the lower frame mount, the push rod 60 together with the upper frame mechanism 70, 72 and 73 will be correspondingly moved upwardly and outwardly or vice versa. The members 72 and 73 are provided with apertures 72' and 73' for reception of locking screws, or locking bolts 75 with lock nut 75' provided thereon, through the bed portion structure 74 of the sofabed with which this mechanism is attached. In other words, the upper frame is mounted to the seat and one-half of the bed structure of the sofa or hide-a-bed construction. When used with the "Magic Bed" as mentioned above, normally ordinary wood screws are provided through the apertures 72' and 73' in order to fasten the upper frame mount to the seat/bed structure. This has been found in actual practice to be entirely satisfactory.

Looking at FIGS. 3, 4 and 5, the actual operation of this device as installed in such a sofabed will now be described. Referenc numeral 80 indicates the general sofabed construction having end members or arm rests 82, a back rest and one-half of the bed support cushions 86, together with the seat support 87 and the seat and one-half of the bed cushions 88 provided thereon. Couch support legs 89 are also provided as best seen in FIGS. 4 and 5. Appropriate base frame structure 84 connects the arm resets and provides the lower frame structure of the couch or sofa itself.

Figure 3:
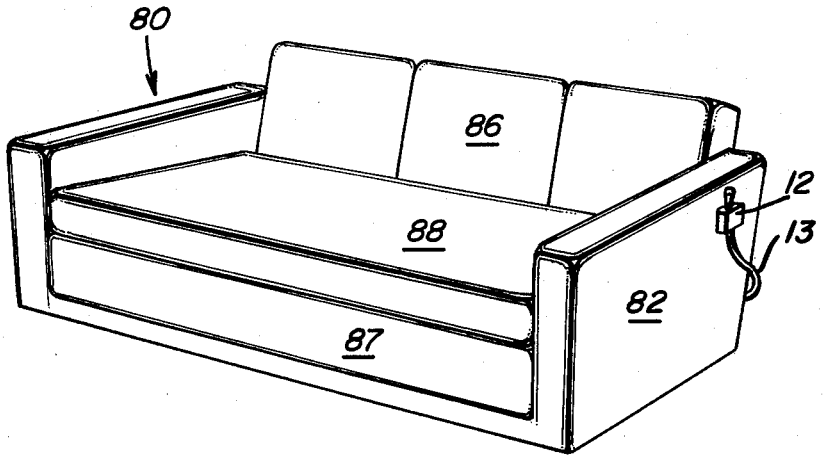
FIG. 3 is a perspective view of a sofabed and large lever switch control at the end thereof with the bed closed and as a couch.
Figure 4:
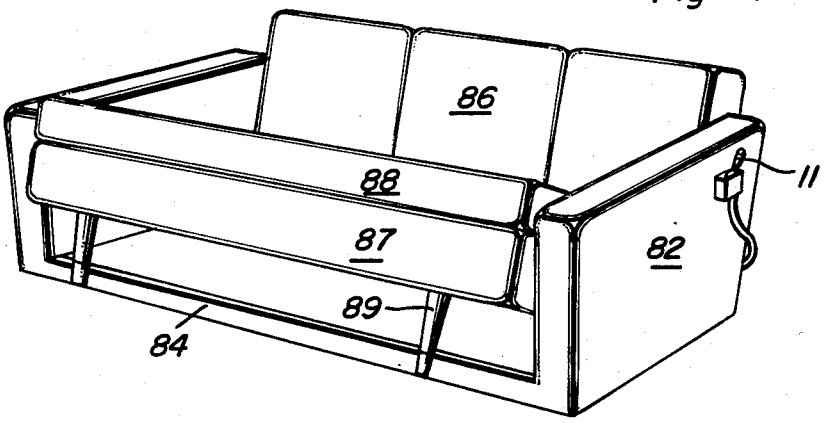
FIG. 4 is a perspective view of the sofabed with the control switch in the closed position, and the bed nearing the fully closed position.
Figure 5:
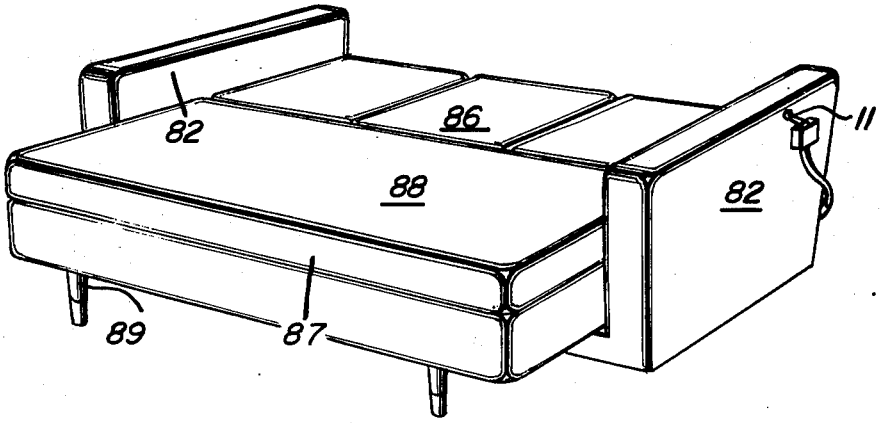
FIG. 5 is a perspective view of the sofabed with the switch in the open position and the sofabed completely open in the bed configuration.

The FIGS. 3–5 show the arthritic-type switch 12 as installed on the one end of the arm rest structures 82. In FIG. 3 the bed is closed and the sofabed is arranged as a conventional type couch structure. The switch bar lever 11 is in the upright center position which is off. This large bar lever for the switch is spring biased normally to this off position. To open the couch, as illustrated in FIG. 5, from the closed position of FIG. 3, the switch 12 is closed to the forward and open position by moving or depressing the bar towards the front of the couch as shown in FIG. 5. When the switch is energized to the open position, the gear motor 20 is actuated, to turn the lead screw 24 which drives the lead nut 32 through the connected cross drive shaft 44 along the slotted tracks 42. This movement is transferred through the linkage connectors 47 to the pivot arms 50. These pivot arms are moved in a simultaneously arching direction. The pivot arms in turn push the upper frame cross rod 60 at the correct force angle as determined by the curved slots 56 in the pivot arms. The force from the pivot arms and cross rod is evenly distributed to the upper frame mount 70, 72, 73 and in turn to the seat of the sofabed. The mechanism will continue to operate until the bed is completely open. If at any point in the movement of this mechanism, the switch is released by one removing their hand therefrom, because of the spring biasing of the lever bar 11, the switch will automatically move to the center, stop position, and the entire mechanism will halt. Also, as indicated above, the motor structure 20 has built-in motor switches which will automatically disengage the electrical energization to said motor when the end limits of the mechanism are reached. Also, because of the built-in overload protection, in case of blockage and stoppage of the overall structure for any emergency or like condition, the motor will be protected from burn out, and also will automatically be stopped to prevent any one from injury from the overall mechanism.

The motorized actuating kit of this invention may be distributed and sold in a preassembled form that can be quickly and easily installed into conventional type sofabeds already out in the field. It also may be installed at the couch and bed factories to be sold initially as a complete actuating unit. The path of force and motion of the actuating mechanism is flexible and adaptable to that of most existing sofabed linkage. The motorized actuating kit of this invention converts motorized lineal motion to an arc-type motion which is then adapted to the existing arc motion of the sofabed construction. The motorized actuating kit of this invention provides the necessary force for the proper movement along the path as designed into existing sofabeds. Normally, this kit may be installed into a sofabed with screws in less than 30 minutes. In the example given above, for installation in a "Magic Bed," the upper frame is screwed to the seat frame and the lower mount is screwed to the sides of the sofabed frame structure. The kit is installed without any alterations whatsoever of the original "Magic Bed."

Because of its durable all-steel construction and simple design, the motorized actuating kit of this invention will provide extra support for the basic sofabed with which it is used. It will require minimum maintenance and with proper usage should last longer than the bed itself.

The foregoing is considered as illustrative only of the principles of the invention. Further, since numerous modifications and changes will readily occur to those skilled in the art, it is not desired of limit the invention to the exact construction and operation shown and described, and accordingly all suitable modifications and equivalents may be resorted to, falling within the scope of the invention.

What is claimed as new is as follows:

1. An actuation apparatus for causing translation of movable portions of a sofa bed and the like between different functional conformations, the apparatus comprising:

a stationary mounting frame connected to stationary portions of the sofa bed;

guide means mounted on the stationary mounting frame on opposite sides thereof, the guide means each having an S-shaped slot formed therein, the slots being aligned;

motor means pivotally mounted on the stationary mounting frame;

screw means driven by the motor means;

cross drive shaft means mounted for driven movement on the screw means;

follower means mounted on each end of the cross drive shaft means, each follower means respectively extending toward the guide means on that side of the stationary mounting frame adjacent said follower means and being slidably received within the slot in said guide means;

link means pivotally connected to the follower means at one end of said link means;

pivot arm means each pivotally mounted at a lower end to the stationary mounting frame adjacent to each of the guide means, the link means being pivotally mounted to each of the pivot arm means medially of the lengths of said pivot arm means, the pivot arm means each having an arcuate slot formed in the upper ends thereof;

cross rod means having follower members at each end thereof, the follower members being slidably received respectively within adjacent arcuate slots in the pivot arm means;

a movable frame mounted to the movable portions of the sofa bed, the cross rod means being connected to the movable frame; and, switch means for activating the motor means, energization of the motor means driving the screw means to cause the cross drive shaft means to be linearly displaced, the follower means following the S-shaped slots in the guide means to cause the link means and the pivot arm means pivotally connected thereto to be displaced vertically, the cross rod means following the slots in the pivot arm means to displace vertically the movable frame and thus the movable portions of the sofa bed connected thereto.

2. The apparatus of claim 1 wherein the pivot arm means are S-shaped in conformation.

3. The apparatus of claim 1 wherein the motor means comprises an electrical motor operable in a forward direction and in a reverse direction.

4. The apparatus of claim 1 wherein the switch means is disposed remotely from the motor means at a location of the sofa bed convenient to a user, the switch means having forward, reverse, and off positions, the switch means having means for biasing said switch means to the off position.

5. The apparatus of claim 1 wherein the cross drive shaft means comprises a bar having a threaded nut connected thereto, the bar having an aperture formed medially of the length of the bar, the nut surmounting the aperture, portions of the screw means being received within the aperture and threadably received within the nut, the bar and nut being moved along the screw means on rotation of the screw means.

* * * * *

UNITED STATES PATENT AND TRADEMARK OFFICE

CERTIFICATE OF CORRECTION

PATENT NO. : 4,074,371

DATED : February 21, 1978

INVENTOR(S) : John L. Lindbloom

It is certified that error appears in the above-identified patent and that said Letters Patent are hereby corrected as shown below:

In the Title, front page, delete "HIDE-A-BED" and substitute --SOFABED--;

In the Abstract, front page, delete "hide-a-beds";

Col. 1, Title, delete "HIDE-A-BED" and substitute --SOFABED--;

Col. 1, line 17, delete ", hide-a-beds,";

Col. 1, line 68, delete "hid-a-beds" and substitute --sofabeds--;

Col. 2, line 22, delete "and hid-a-beds";

Col. 2, line 35, delete "hide-a-bed" and substitute --sofabed--;

line 39, delete "hide-a-bed" and substitute --sofabed--;

line 45, delete "hide-a-bed" and substitute --sofabed--;

line 47, delete "hide-a-bed" and substitute --sofabed--;

line 49, delete "hide-a-bed" and substitute --sofabed--;

Col. 3, line 61, delete "hide-a-bed" and substitute --sofabed--;

Col. 4, line 23, delete ", hide-a-beds, etc.";

Col. 5, line 27, delete "or hide-a-bed".

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*